US006996861B1

(12) United States Patent
Clark, Jr.

(10) Patent No.: US 6,996,861 B1
(45) Date of Patent: Feb. 14, 2006

(54) SHOWER MOUNTED BACK CLEANSING AND MASSAGING APPARATUS

(76) Inventor: Aaron Thomas Clark, Jr., 4A Parker Ave., Annapolis, MD (US) 21401-3228

( * ) Notice: Subject to any disclaimer, the term of this patent is extended or adjusted under 35 U.S.C. 154(b) by 0 days.

(21) Appl. No.: 10/843,520

(22) Filed: May 11, 2004

Related U.S. Application Data

(60) Provisional application No. 60/468,820, filed on May 9, 2003.

(51) Int. Cl.
*A47K 7/02* (2006.01)

(52) U.S. Cl. ..... 4/606

(58) Field of Classification Search ..... 4/606; 15/88.2–88.3, 97.1
See application file for complete search history.

(56) References Cited

U.S. PATENT DOCUMENTS

| | | | | |
|---|---|---|---|---|
| 3,875,604 A | | 4/1975 | Wurn et al. | |
| 4,008,503 A | * | 2/1977 | Tharp | 15/88.3 |
| 4,040,132 A | | 8/1977 | Braun | |
| 4,696,068 A | | 9/1987 | Kenner | |
| 4,704,756 A | | 11/1987 | Williams et al. | |
| 4,933,999 A | | 6/1990 | Mikiya et al. | |
| 4,955,101 A | | 9/1990 | King | |
| 5,239,712 A | * | 8/1993 | Kinder | 4/606 |
| 5,345,640 A | * | 9/1994 | Goss | 15/88.2 |
| 5,561,869 A | * | 10/1996 | Sarel | 4/606 |
| 5,774,907 A | | 7/1998 | Doggwiler | |
| 6,338,170 B1 | | 1/2002 | De Simone | |
| 6,732,394 B1 | * | 5/2004 | Waterman | 15/97.1 |

* cited by examiner

*Primary Examiner*—Charles E. Phillips
(74) *Attorney, Agent, or Firm*—John D. Gugliotta

(57) ABSTRACT

A selectable shower scrubber massager is an apparatus to aid in the scrubbing and cleaning of one's back while in the shower. The apparatus is suspended from the shower head from an adjustable hanger that permits vertical adjustment of the body of the apparatus. The body has three separate sections of brushes designed to clean and/or massage the upper, middle and lower areas of the back. Each section is provided with rotating brushes controlled by a variable speed motor. Each section also has a soap dispenser that provides for the application of liquid soap from an integral interior dispenser. On the back of the invention are a set of four suction cups to aid in attaching the invention to the shower or bath wall. Control switches and speed adjustments for each section are provided operatively coupled with a power source.

12 Claims, 2 Drawing Sheets

SHOWER MOUNTED BACK CLEANSING AND MASSAGING APPARATUS

RELATED APPLICATIONS

This application claims the benefit of U.S. Provisional Application Ser. No. 60/468,820 filed on May 9, 2003.

BACKGROUND OF THE INVENTION

1. Field of the Invention

The present invention relates generally to shower accessories and, more particularly, to a shower mounted back cleaning and massaging apparatus 2. Description of the Related Art The age-old problems associated with the washing of one's back has never really been solved. Long-handled scrub brushes have been used in the past, but they are often difficult to use and ineffective due to the fact that full back coverage or adequate scrubbing action is often not accomplished. Also when one is taking a shower, vigorous scrubbing action is tiring work and many people quickly tire of reaching behind their back. This does not even take into account the elderly or physically disabled who are incapable of cleaning their back area. Accordingly, there is a need for a means by which an individual can quickly and easily cleanse, and scrub their back area of their body while in the shower without the disadvantages normally associated with conventional back cleaning methods.

A search of the prior art did not disclose any patents that read directly on the claims of the instant invention; however, the following references were considered related:

U.S. Pat. No. 6,338,170, issued in the name of De Simone, discloses a hand-held or fixed massage shower having one or more spouts and one or more massaging means;

U.S. Pat. No. 5,774,907, issued in the name of Doggwiler, discloses a shower wall back scrubber and massager fluidly connectable to a shower head;

U.S. Pat. No. 3,875,604, issued in the name of Wurn et al., discloses a shower wall back scrubber and massager having a water fed brush that rotates while it oscillates vertically;

U.S. Pat. No. 4,040,132, issued in the name of Braun, discloses a plurality of cylindrical scrubbers open inwardly of a shower enclosure;

U.S. Pat. No. 4,696,068, issued in the name of Kenner, discloses a shower wall and bathtub mounted back washer having a pad of foam plastic with a waterproof cover;

U.S. Pat. No. 4,704,756, issued in the name of Williams et al., discloses a reciprocating shower brush head assembly;

U.S. Pat. No. 4,955,101, issued in the name of King, discloses a body scrubbing brush apparatus; and U.S. Pat. No. 4,933,999, issued in the name of Mikiya et al., discloses a massage action shower head and massaging shower apparatus.

Consequently, a need has been felt for providing an apparatus and method of cleansing and/or massaging the back of a user.

SUMMARY OF THE INVENTION

It is therefore an object of the present invention to provide an improved shower mounted cleansing and massaging apparatus.

It is a feature of the present invention to provide an improved shower apparatus having a plurality of brushes for cleansing and/or massaging the back of a user.

It is an additional feature of the present invention to provide an improved shower apparatus having varying sizes of brushes for variable effects of cleansing and/or massaging.

It is an additional feature of the present invention to provide an improved shower apparatus having a hanging bracket with support arms engaging and impinged by a base holder for selective vertical adjustment.

Briefly described according to one embodiment of the present invention, a selectable shower scrubber massager is an apparatus to aid in the scrubbing and cleaning of one's back while in the shower. The invention is designed to hang from the shower head from an adjustable hanger that allows the body of the invention to move up and down to suit the height of various users. The invention consists of three separate sections of brushes designed to clean the upper, middle and lower areas of the back. Each section is provided with rotating brushes controlled by a variable speed motor. Each section also has a soap dispenser that provides for the application of liquid soap from an integral interior dispenser. On the back of the invention are a set of four suction cups to aid in attaching the invention to the shower or bath wall. Also, on the back are a set of three battery compartments which house batteries to power the invention. Control switches and speed adjustments for each section are provided on the side of the invention opposite of the soap dispenser and controls.

The use of the present invention allows one to clean their back while in a shower or bath in a quick, easy and effective manner.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

| DESCRIPTIVE KEY | |
|---|---|
| 10 | shower mounted back cleansing and massaging apparatus |
| 15 | base holder |
| 20 | hanging bracket |
| 25 | suction cups |
| 30 | shower or wall surface |
| 35 | shower head piping |
| 40 | shower head |
| 45 | protrusions |
| 50 | support arms |
| 55 | upper engagement button |
| 60 | lower engagement button |
| 65 | direction arrow |
| 70 | brush enclosure section |
| 75 | upper brush section |
| 80 | middle brush section |
| 85 | lower brush section |
| 90 | rotating bristle brushes |
| 95 | upper row power switch |

-continued

| DESCRIPTIVE KEY | |
|---|---|
| 100 | upper row speed selector |
| 105 | middle row power switch |
| 110 | middle row speed selector |
| 115 | lower row power switch |
| 120 | lower row speed selector |
| 125 | channel slots |
| 130 | recessed opening |
| 135 | liquid soap filler cap |
| 140 | liquid soap delivery pump on/off switch |
| 145 | battery access cover |
| 150 | batteries |
| 155 | main power switch |
| 160 | release tabs |

DESCRIPTION OF THE PREFERRED EMBODIMENTS

Figure 1:
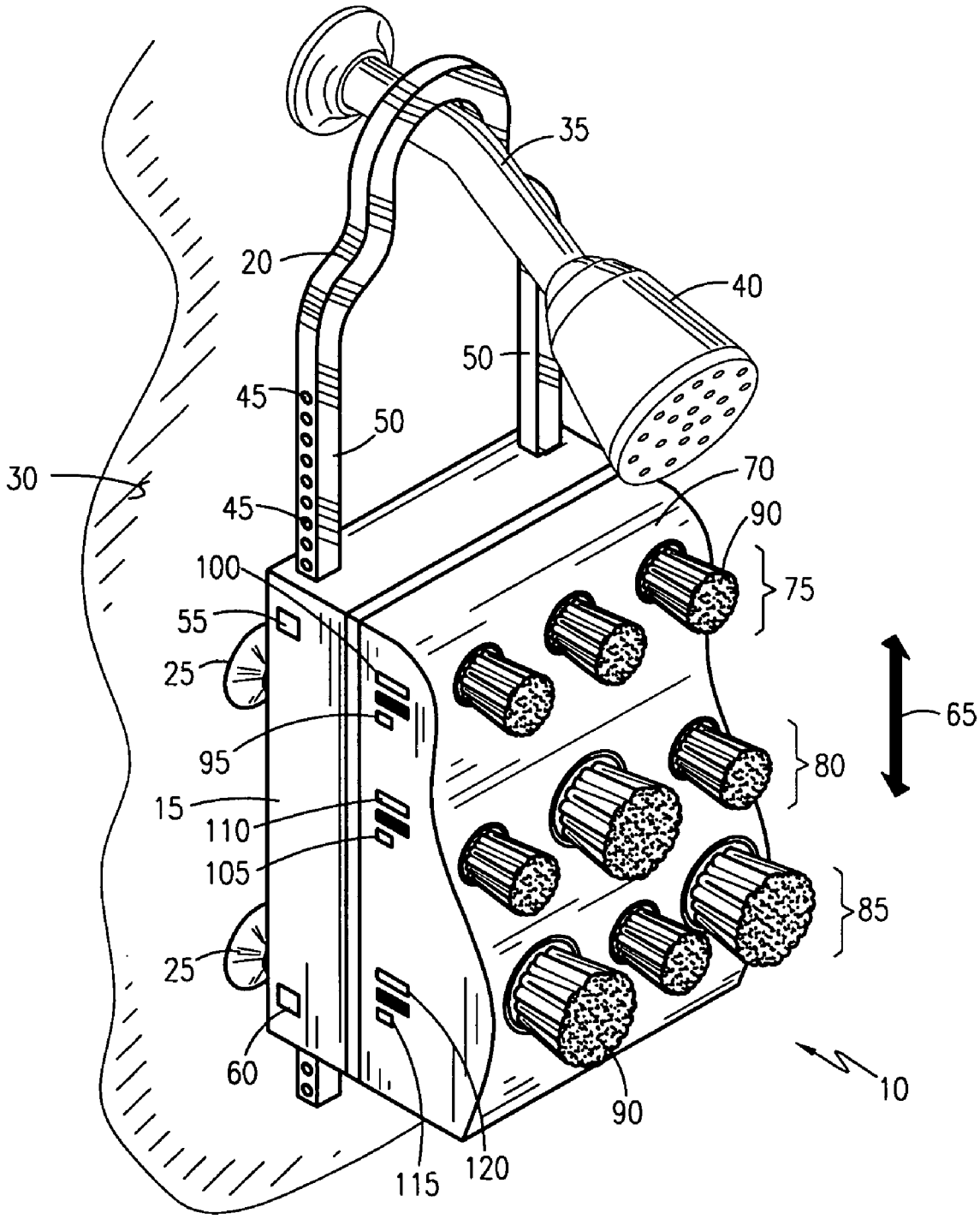
FIG. 1 is a front isometric view of the shower mounted back cleansing and massaging apparatus 10, shown in an installed state, according to the preferred embodiment of the present invention.
Figure 2:
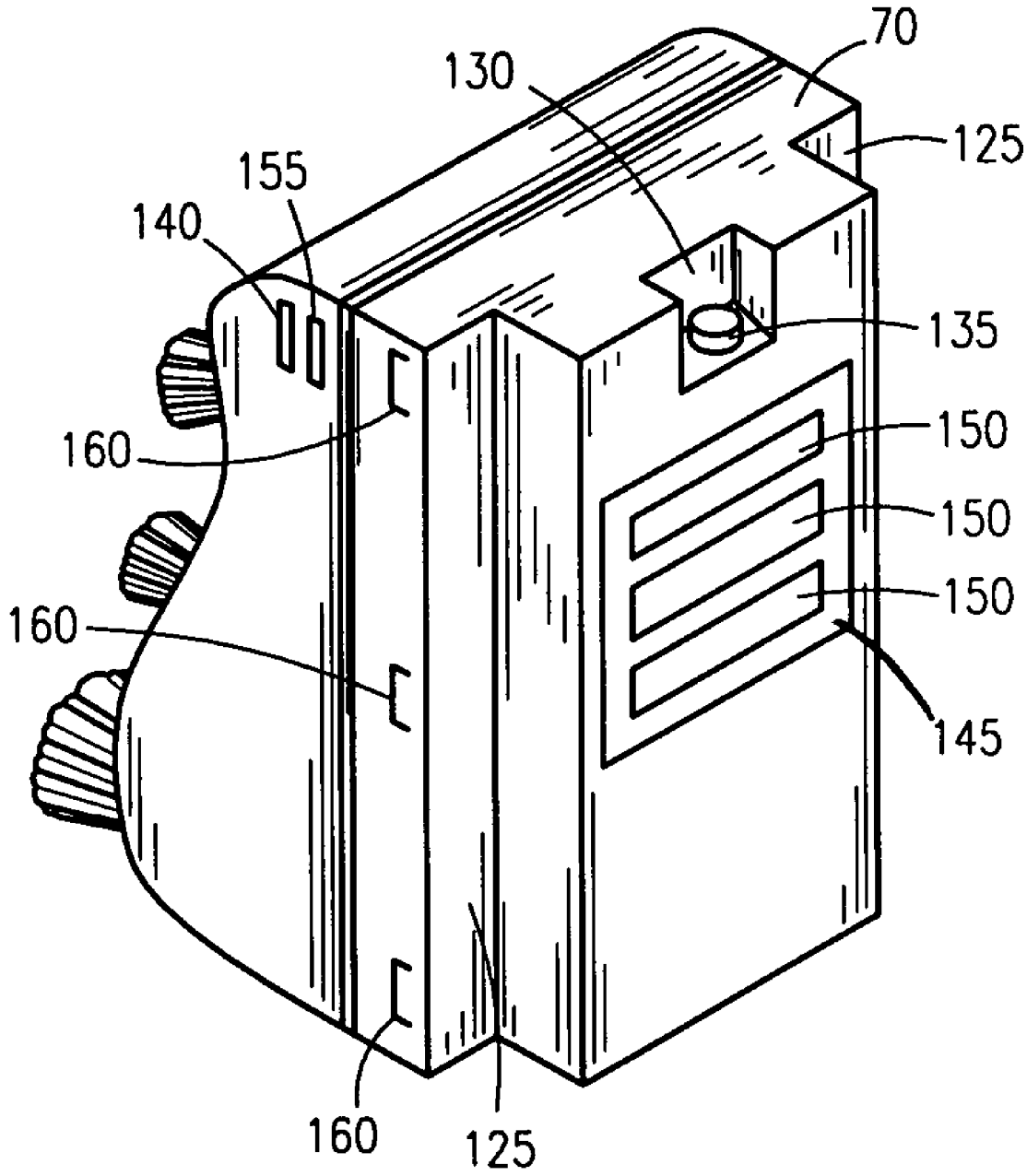
FIG. 2 is a rear isometric view of the brush enclosure section 70, as used with the shower mounted back cleansing and massaging apparatus 10.

The best mode for carrying out the invention is presented in terms of its preferred embodiment, herein depicted within the FIGS. 1 and 2.

1. Detailed Description of the Figures

Referring first to FIG. 1, a front isometric view of the shower mounted back cleansing and massaging apparatus 10 according to the preferred embodiment of the present invention. It is shown in an installed state ready to be utilized by a user. The shower mounted back cleansing and massaging apparatus 10 consists of a base holder 15, which is basically a box-like tray which is supported by mechanical support of a hanging bracket 20. For additional rigidity and prevention of motion, a series of four suction cups 25, (only two of which are shown here for sake of clarity) secure the base holder 15 to a shower or wall surface 30. The hanging bracket 20 receives its hanging support from a section of shower head piping 35 normally provided in a conventional bath or shower for a shower head 40. The hanging bracket 20 provides a series of regularly space protrusions 45 along its outward side as shown, down one of two support arms 50. These protrusions 45 are provided on both support arms 50, but are shown only on one for purposes of clarity. The protrusions 45 are engaged by an upper engagement button 55 and a lower engagement button 60. Both the upper engagement button 55 and the lower engagement button 60 must be pressed inward to allow the base holder 15 to slide up and down as defined by a direction arrow 65. Such a feature allows use of the shower mounted back cleansing and massaging apparatus 10 by users of all heights, as well as accommodating shower head piping 35 and shower head 40 of different installed heights. A brush enclosure section 70 contains an upper brush section 75, a middle brush section 80 and a lower brush section 85, each of which contains three rotating bristle brushes 90 of varying sizes. The rotating bristle brushes 90 are interchangeable amongst same sizes and are replaceable should they become worn with time. An upper row power switch 95 and an upper row speed selector 100 provide for the operation and speed setting respectively of the upper brush section 75. A middle row power switch 105 and middle row speed selector 110 provide for the operation and speed setting respectively of the middle brush section 80. A lower row power switch 115 and lower row speed selector 120 provide for the operation and speed setting respectively of the lower brush section 85. This feature allows the user to select whether a row of rotating bristle brushes 90 operates during a cleansing or massage of one's back, and if it does, how fast the various rows of rotating bristle brushes 90 operate.

Referring now to FIG. 2, a rear isometric view of the brush enclosure section 70, as used with the shower mounted back cleansing and massaging apparatus 10 is disclosed. The brush enclosure section 70 provides for two channel slots 125 along its rearward edge to accommodate the support arms 50 (as shown in FIG. 1). A recessed opening 130 allows access to a liquid soap filler cap 135 by which the user may add liquid soap or similar agent for use during a back cleansing and massaging operation. The delivery of the liquid soap from an internal reservoir, through a pump, and to the rotating bristle brushes 90 (as shown in FIG. 1) is governed by a liquid soap delivery pump on/off switch 140. Located on the rear of the brush enclosure section 70 is a battery access cover 145 which houses three internal batteries 150. The application of power from the batteries to the liquid soap delivery pump on/off switch 140 as well as the upper row power switch 95 (as shown in FIG. 1), the middle row power switch 105 (as shown in FIG. 1), and the lower row power switch 115 (as shown in FIG. 1) is governed by a main power switch 155 located immediately behind the liquid soap delivery pump on/off switch 140. In such a manner, the user can activate and deactivate the entire shower mounted back cleansing and massaging apparatus 10 without having to utilize multiple switches. The battery powered nature of the shower mounted back cleansing and massaging apparatus 10 allows it to be used without connection to alternating current power thus no power cords are necessary, and the risk of electric shock is practically eliminated. A series of friction-fit release tabs 160 are provided to allow the brush enclosure section 70 to slide into the base holder 15 (as shown in FIG. 1), and be secured in place. The brush enclosure section 70 can be quickly released from the base holder 15 (as shown in FIG. 1) using the same release tabs 160 without the use of tools. Such access is important when refilling the liquid soap via the liquid soap filler cap 135 or replacing the batteries 150 via the battery access cover 145.

It is envisioned that other styles and configurations of the present invention can be easily incorporated into the teachings of the present invention, and only one particular configuration will be shown and described for purposes of clarity and disclosure and not by way of limitation of scope.

2. Operation of the Preferred Embodiment

The preferred embodiment of the present invention can be used by the common user in a simple and effortless manner, with minimal training. After procurement of the shower mounted back cleansing and massaging apparatus 10, it must first have batteries 150 installed within the battery access cover 145 and liquid soap added via the liquid soap filler cap 135. Next, the shower mounted back cleansing and massaging apparatus 10 is carefully hung from the shower head piping 35, and adjusted to the correct height using the upper engagement button 55 and lower engagement button 60 in conjunction with the protrusions 45 on the support arms 50. Once the necessary height adjustment is obtained, the shower mounted back cleansing and massaging apparatus 10 is additionally secured to the shower or wall surface 30 using the four suction cups 25 located on the rear of the base holder 15. At this point, the shower mounted back cleansing and massaging apparatus 10 is ready for use in an actual shower situation.

Once the user is in the shower and in the process of cleansing, and wishes to utilize the features of the shower mounted back cleansing and massaging apparatus 10, a decision on whether a cleansing massage or a regular massage must be made. In the event of a regular massage, the liquid soap feature associated with the liquid soap delivery pump on/off switch 140 is left in the OFF position. If a cleansing massage is desired, the liquid soap delivery pump on/off switch 140 is placed into the ON position. Next the user must decide if which of the three rows of rotating bristle brushes 90 should be activated and the associated speed of the rotating bristle brushes 90. The upper brush section 75 is activated by the upper row power switch 95 and the speed of the associated revolutions is controlled by the upper row speed selector 100. The middle brush section 80 is activated by the middle row power switch 105 and the speed of the associated revolutions is controlled by the middle row speed selector 110. The lower brush section 85 is activated by the lower row power switch 115 and the speed of the associated revolutions is controlled by the lower row speed selector 120. At this point the user is able to activate and deactivate the entire shower mounted back cleansing and massaging apparatus 10 by use of the main power switch 155. During the actual cleansing or massaging operation, the user simply rubs his or her back up against the various rows of rotating bristle brushes 90 to cover their entire back. After completion of the massaging and/or cleansing process, the user simply deactivates the main power switch 155 and rinses the rotating bristle brushes 90 to complete the cycle and make it ready for the next operating time or cycle.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be limited only by the following claims.

What is claimed is:

1. A selectable shower scrubber massager designed to hang from the shower head from an adjustable hanger that allows the body of the invention to move up and down to suit the height of various users and comprising:

three separate sections of brushes designed to clean the upper, middle and lower areas of the back, wherein each section is provided with rotating brushes controlled by a variable speed motor;

wherein said brushes are rotatable for cleaning and massaging the back of a user and;

wherein said sections comprise:

an upper brush section;

a middle brush section;

a lower brush section;

wherein each one of said sections are separately controlled by a power switch and a speed selector.

2. The selectable shower scrubber massager of claim 1 further comprising a recessed opening providing ingress to a reservoir, said reservoir storing detergent or therapeutic preparations for dispensing through said brushes.

3. The selectable shower scrubber massager of claim 1 further comprising a power source operatively coupled with said motor for operating said brushes.

4. A cleansing and/or massaging apparatus mounted in a shower comprising:

a base holder supporting a brush enclosure section and having suction cups at a posterior portion for secure attachment to a vertical surface;

said brush enclosure section having a plurality of rotating bristle brushes;

a hanging bracket having support arms, said support arms engaging said base holder and vertically adjustable therewith, said hanging bracket suspended from a shower head pipe; and a power source operatively coupled to said brushes and at least one power switch for controlling operation of said brushes.

5. The apparatus of claim 4, wherein said brush enclosure section comprises an upper brush section, a middle brush section, and a lower brush section, each one of said sections comprises a plurality of bristle brushes, and wherein each one of said sections are separately controlled by a power switch and a speed selector.

6. The apparatus of claim 5, wherein each one of said sections comprises said bristle brushes of varying size.

7. The apparatus of claim 6, wherein said bristle brushes are interchangeable between said sections.

8. The apparatus of claim 1, wherein said hanging bracket has a series of regularly spaced protrusions along an external surface of each one of said arms, said protrusions engaging an upper engagement button and a lower engagement button provided at each side of said base holder, said buttons impinging said arms and maintaining a selected position.

9. The apparatus of claim 4 further comprising a recessed opening providing ingress to a reservoir, said reservoir storing detergent or therapeutic preparations for dispensing through said brushes.

10. The apparatus of claim 9, said reservoir operatively coupled with a pump for dispensing the detergent or therapeutic preparations through said brushes.

11. The apparatus of claim 10, said pump operatively coupled with an on/off switch for actuating said pump.

12. The apparatus of claim 4, wherein said brush enclosure section is slidably removable from said base holder via friction-fit release tabs.

* * * * *